US005330376A

United States Patent [19]

Okumura

[11] Patent Number: 5,330,376

[45] Date of Patent: Jul. 19, 1994

[54] WATER COOLING SYSTEM FOR A MARINE PROPULSION UNIT

[75] Inventor: Shigeo Okumura, Hamamatsu, Japan

[73] Assignee: Sanshin Kogyo Kabushiki Kaisha, Hamamatsu, Japan

[21] Appl. No.: 762,510

[22] Filed: Sep. 19, 1991

[30] Foreign Application Priority Data

Sep. 20, 1990 [JP] Japan ..... 2-248892

[51] Int. Cl.[5] ..... B63H 21/10

[52] U.S. Cl. ..... 440/88; 123/41.08

[58] Field of Search ..... 440/88; 123/41.01, 41.04, 123/41.05, 41.08, 41.09, 41.13; 137/505, 505.13, 505.38, 505.39, 505.42, 505.43, 505.46, 505.36, 505.37, 115, 495; 251/61.5; 236/101 C, 34.5

[56] References Cited

U.S. PATENT DOCUMENTS

| | | | |
|---|---|---|---|
| 4,133,284 | 1/1979 | Holcroft | 440/88 |
| 4,357,912 | 11/1982 | Brown | 440/900 |
| 4,457,727 | 7/1984 | Flaig | 440/88 |
| 4,669,988 | 6/1987 | Breckenfeld | 440/88 |
| 4,741,715 | 5/1988 | Hedge | 440/88 |

FOREIGN PATENT DOCUMENTS 61-48687 3/1986 Japan .

2-12799 3/1990 Japan .

*Primary Examiner*—Robert J. Oberleitner
*Assistant Examiner*—Clifford T. Bartz
*Attorney, Agent, or Firm*—Knobbe, Martens, Olson & Bear

[57] ABSTRACT

A pressure sensitive valve device is provided for use in a cooling system for the engine of a marine propulsion unit. The pressure sensitive valve device of the invention communicates with the coolant line pressure of an engine cooling jacket at both a coolant input port region of the cooling jacket and a coolant output port region of the cooling jacket. When the difference in pressure between these two regions exceeds a predetermined limit the pressure sensitive valve device opens, thereby permitting coolant to pass therethrough. The cooling system also employs a temperature sensitive valve device positioned in parallel with the pressure sensitive valve device. The temperature sensitive valve device is operative to control coolant flow within the engine in the low RPM operation range, while the pressure sensitive valve device becomes operative to control coolant flow in the high RPM operation range, where the thermal load of the engine is great. Thus, sufficient coolant flow may be achieved throughout the entire engine operating range.

23 Claims, 4 Drawing Sheets

WATER COOLING SYSTEM FOR A MARINE PROPULSION UNIT

BACKGROUND OF THE INVENTION

This invention relates to a water cooling system for an engine, employable in connection with a marine propulsion unit; and more specifically, to a valve arrangement for controlling coolant flow through the cooling system.

It has been known to employ an engine as a powering means in connection with marine propulsion units. Cooling systems in such engines have included means for introducing a coolant, such as water from the body of water within which the marine craft is operated, into the engine. Valving arrangements have commonly been employed to control the flow of coolant through the engine, in order to maintain desired engine temperatures during operation.

Concerning such valve control arrangements, it has specifically been known to include both a thermostatically controlled valve and a pressure actuated valve for controlling coolant flow. Such a system employing both a thermo-sensitive control valve and a pressure-sensitive control valve has been disclosed in Japanese Unexamined Patent Publication Sho61-48687. The thermo-sensitive valve primarily controls the coolant flow under low RPM operating conditions. The maximum amount of coolant which will flow through the engine as a result of the opening of the thermo-sensitive control valve, however, may not be sufficient to allow proper cooling of the engine under higher loads. To increase the flow of coolant in the high RPM range, where the thermal load of the engine is higher, a pressure-sensitive control valve is provided.

However, certain problems have been encountered when utilizing known pressure-sensitive valves for the above-discussed purpose. For example, sufficient water flow cannot be achieved in the high RPM operation range when a pressure-sensitive control valve 1 of the type shown in FIG. 1 is used. Although the valve body 2 will become unseated, thereby opening the valve device 1, when the pressure rises on the water jacket side (indicated by the arrow accompanying the notation "in"), the valve body 2 will immediately return to its seated, closed position, under the force of the spring member 3, due to a resulting subsequent drop in pressure on the water jacket side. Accordingly, repeated opening and closing of the valve device will occur, thereby rendering adequate water flow impossible to achieve.

The valve device 4 of FIG. 2 overcomes some of the problems of the device of FIG. 1 by retarding such closing of the valve body 5 immediately after opening via a diaphragm 6 exposed to atmospheric pressure. However, the valve device 4 requires the use of a throttling area 7 along the discharge passage 8 in order to achieve such results. The throttling area 7 impairs the achievement of a sufficient water flow.

It is, therefore, a primary purpose of this invention to provide an improved water flow control arrangement for use in a water cooling system for the engine of a marine propulsion unit.

It is yet a further object of this invention to provide an improved pressure-sensitive valve device for such a water cooling system which allows the achievement of a sufficient coolant flow rate in the high RPM operation range of an engine.

SUMMARY OF THE INVENTION

This invention is adapted to be embodied in a water cooling system for a marine propulsion unit. The invention comprises a coolant jacket having an input port and a discharge port. A pressure sensitive valve device is provided which is responsive to a pressure differential in the coolant jacket. The pressure sensitive valve device opens to coolant flow therethrough when the pressure differential exceeds a predetermined limit. A temperature sensitive valve device is also provided. The temperature sensitive valve device and the pressure sensitive valve device are positioned within the cooling system in parallel flow paths. Also, the pressure sensitive valve device and the temperature sensitive valve device are located just beyond the discharge port of the coolant jacket.

DETAILED DESCRIPTION OF THE PREFERRED EMBODIMENT

Figure 1:
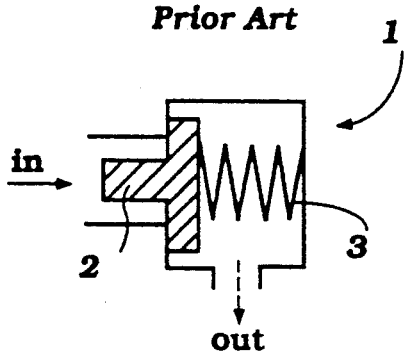
Figure 1 Prior Art
FIG. 1 is a partially schematic view of one prior valve device for use in controlling coolant flow in an engine cooling system.
Figure 2:
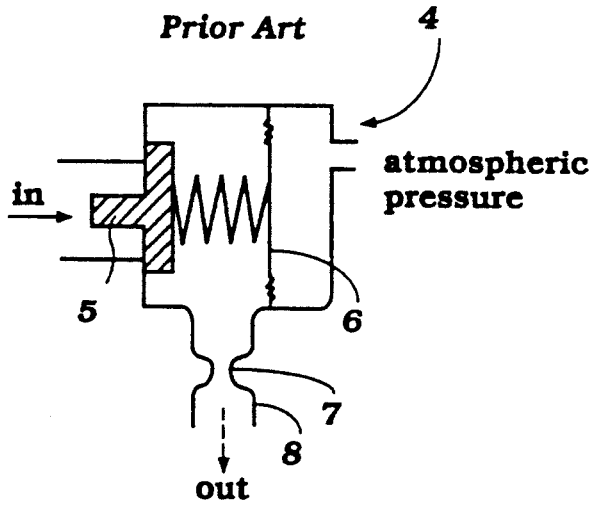
Figure 2 Prior Art
FIG. 2 is a partially schematic view of another prior valve device for use in controlling coolant flow in an engine cooling system.
Figure 3:
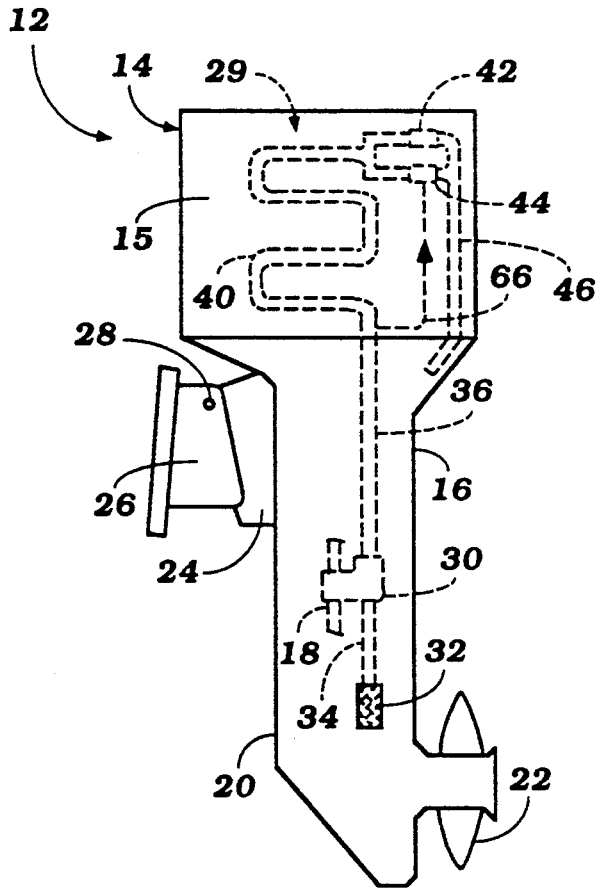
FIG. 3 is a side elevational view of an outboard motor suitable for use in connection with the cooling system of the present invention.

Referring first primarily to FIG. 3, an outboard motor constructed in accordance with this invention is identified generally by the reference numeral 12. The motor 12, includes a power head, indicated generally by the reference numeral 14, which includes a water cooled internal combustion engine 15 and a surrounding protective cowling. A drive shaft housing 16 depends from the power head 14 and rotatably supports a drive shaft, shown in part in phantom and indicated by the reference numeral 18, that is driven in a known manner by the engine 15. A lower unit 20 is positioned beneath the drive shaft housing 16 and includes a forward, neutral, reverse transmission system (not shown) for driving a propeller 22.

The outboard motor 12 is adapted to be affixed to the transom of an associated watercraft (not shown) for steering about a generally vertically extending axis and for tilting about a generally horizontally extending axis by means of a mounting assembly, which is described next.

A steering shaft (not shown) is affixed to the drive shaft housing 16 and is rotatably journalled in a swivel bracket 24. This rotational movement accommodates steering of the outboard motor 12 about a vertically extending axis defined by the axis of rotation of the steering shaft within the swivel bracket 24.

The swivel bracket 24 is, in turn, pivotally connected to a clamping bracket 26 by means of a pivot pin 28. This pivotal connection permits tilting of the outboard motor 12 about the horizontally disposed axis defined by the pivot pin 28 for trim adjustment and so that the outboard motor 12 may be tilted up to an out of the water condition during trailering and when not in use. The clamping bracket 26 carries a clamping device (not shown) so as to permit attachment of the outboard motor 12 to the transom of an associated watercraft.

The engine of the invention is also provided with a cooling system 29. In the illustrated embodiment, the engine is water cooled and draws cooling water from the body of water in which the watercraft is operating. This is accomplished, in part, by means of a water pump 30 which is located within the drive shaft housing 16 and which is driven by the drive shaft 18, in a known manner. Water is drawn from the body in which the watercraft is operating through an inlet 32 and upwardly towards the coolant pump 30 through a conduit 34. The water is then discharged from the pump 30 through a supply conduit 36 which extends upwardly through the drive shaft housing 16 and which terminates at an engine cooling jacket, indicated generally by the reference numeral 40.

A valve arrangement is located along a discharge region of the engine cooling jacket 40. This arrangement includes a pair of control valves 42 and 44 positioned in parallel with one another. Each control valve, 42 and 44, communicates at its outlet portion with a discharge passage 46. Water coolant, having passed through one of the control valves, is returned to the body of water within which the watercraft is operating via the discharge passage 46, in an appropriate manner.

The control valve 42 is a thermo-sensitive control valve. The thermo-sensitive valve 42 employed with this invention may be of any appropriate known type. Generally, operation of such a valve involves a thermostat which opens and closes the valve to the passage of coolant water according to a desired water temperature.

Figure 4:
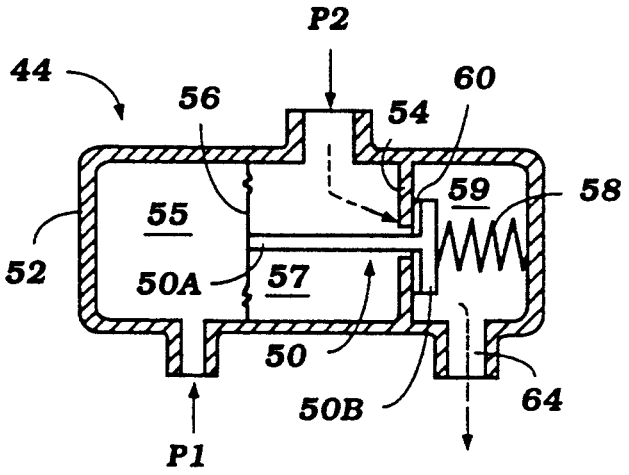
FIG. 4 is a partially schematic view of a pressure-sensitive valve device constructed in accordance with this invention.

The control valve 44 is a pressure-sensitive control valve. The structure of the pressure-sensitive control valve 44, according to this invention, is shown in FIG. 4. A T-shaped valve body 50 is disposed within an encasement assembly 52. The valve body 50 includes a stem portion 50A and a cross-bar portion 50B. The inside of the encasement assembly 52 is divided into three distinct sections by a partition 54 and a diaphragm 56. The partition 54 is formed integrally with the encasement assembly 52. Further, the partition 54 is provided with a hole in its central region, through which the stem portion 50A of the valve body 50 passes. The diaphragm 56 is movable within the encasement assembly in a back and forth direction. The end of the stem portion 50A of the valve body 50 contacts a central area of the diaphragm 56 so that such back and forth movement may be imparted to the valve body 50.

The cross-bar portion 50B of the valve body 50 lies on a side of the partition 54 opposite the side adjacent the diaphragm 56. The cross-bar portion 50B is urged against the partition by way of a spring member 58. A rubber sealing washer 60 is attached to the cross-bar portion 50B, around the stem portion 50A, to seal the valve member 44 closed to water flow under certain conditions, to be described below. It should be noted that the diameter of the hole is greater than the diameter of the valve stem 50A so that water may pass through the hole when the cross-bar portion 50B and sealing washer 60 are not engaging the partition 54.

As shown in FIG. 4, the encasement assembly 52 is provided with two inlet passages and one outlet passage. A first inlet passage allows water to enter a first chamber 55 within the encasement assembly 52, bounded by the inner wall of the encasement 52 and the diaphragm 56. Flow into this chamber is indicated in the drawing by the arrow accompanying the notation P1. A second inlet passage allows water to enter a middle chamber 57 within the encasement assembly 52, bounded by the encasement inner wall, the diaphragm 56 and the partition 54. Flow into this chamber is indicated by the arrow accompanying the notation P2. The outlet passage is denoted by the reference numeral 64, and allows water to exit from a third chamber 59 within the encasement assembly 52, bounded by the inner wall of the encasement 52 and the partition 54.

The operation of the pressure-sensitive control valve 44 within the context of the overall cooling system 29 will now be described. A coolant conduit 66 (FIG. 3) communicates water flowing through the engine coolant jacket 40 with the first chamber 55 of the valve 44. Water flow within this conduit 66 supplies a water pressure P1 to the chamber 55, and consequently, against the side of the diaphragm 56 facing the chamber 55. The pressure P1 is representative of the line pressure within the water jacket 40 at a location proximate to the point where water is introduced into the water jacket 40 from the supply conduit 36. The water jacket 40 itself leads directly to the valve 44 and supplies a water pressure P2 to the chamber 57, and consequently against the side of the diaphragm 56 facing the chamber 57. The pressure P2 is representative of the line pressure within the water jacket at the end of the water jacket 40 line.

Figure 5:
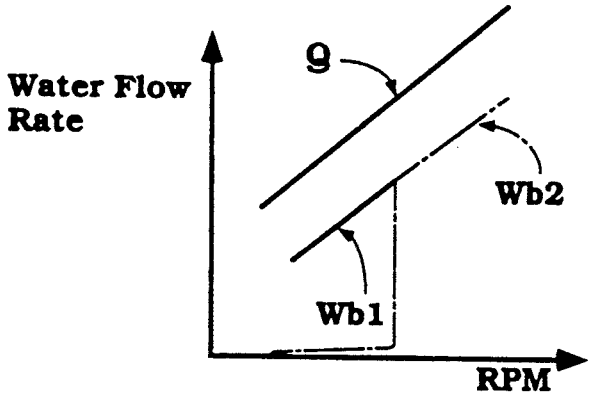
FIG. 5 is a graph of the water coolant flow rate as a function of engine RPM, showing the delivery flow rate Q of a water pump to the engine cooling jacket, as well as the controlled water flow rate through the cooling system employing a thermo-sensitive valve ($W_{b1}$) and, additionally, the pressure-sensitive valve ($W_{b2}$) of this invention.
Figure 6:
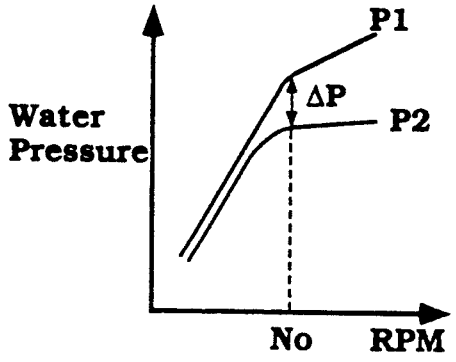
FIG. 6 is a graph of the coolant system water pressure as a function of engine RPM, showing how the pressure difference −P (where P1 and P2 are water pressures along different regions of the engine coolant jacket) increases with an increase in RPM.

As a consequence of an increase in the engine speed, the temperatures of the engine and coolant liquid rise, as is well known in the art. As shown in FIGS. 5 and 6, additionally the coolant delivery rate and coolant jacket water pressure increase as the engine speed is increased. As will be discussed below, the thermo-sensitive valve is operational to open during relatively low engine speed operation, in response to the temperature of the coolant in the water jacket. However, when the thermo-sensitive valve is fully opened, and thus the coolant temperature is elevated, the pressure sensitive valve is employed to help accommodate the increased flow of coolant supplied by the coolant pump during high engine speed operation.

The pressure-sensitive control valve 44 is operable in response to the difference between the water pressures P1 and P2, denoted herein as _P (i.e., _P=P1−P2). The valve 44 is set to open during high RPM operation of the engine 15, when the pressure difference _P exceeds a predetermined value. This predetermined value is controlled by the force applied by the spring member 58 against the valve body 50 tending to seat the valve body 50 in its closed position. The pressure differential _P must exceed the spring's force in order to open the valve 44. That is, the predetermined value which _P must exceed in order to open the valve 44 is equal to the force applied against the valve body 50 by the spring member 58.

The thermo-sensitive control valve 42 opens in response to the coolant temperature. If the temperature of the coolant increases to the opening temperature, the thermostat of the valve 42 will open slightly. As the temperature of the coolant further increases, the thermostat opens more, allowing more coolant to reduce the engine temperature. When the engine 15 is under high loads, the thermostat will be opened fully.

The maximum amount of coolant which will flow through the engine 15 as a result of the opening of the thermo-sensitive control valve 42, however, may not be sufficient to allow proper cooling of the engine under higher loads. Therefore, this invention provides, in parallel with the thermo-sensitive control valve 42, the pressure-sensitive control valve 44, as set out above, which opens at an engine RPM exceeding a predetermined limit so that the required water flow may be achieved.

As shown in FIG. 5, the delivery flow rate Q of the water pump 30 increases linearly as the engine RPM increases. $Wb_1$ is a controlled water flow rate through the thermo-sensitive control valve 42, and $Wb_2$ is a controlled water flow rate through the pressure-sensitive control valve 44. With further reference to FIG. 6, the pressure-sensitive control valve 44 is set to open at an engine RPM exceeding $N_0$ at which the pressure differential _P exceeds this predetermined limit, utilizing the phenomenon, as is shown in the Figure, that the pressure differential _P increases as the engine RPM rises, which is due to flow resistance within the water jacket 40.

Figure 7:
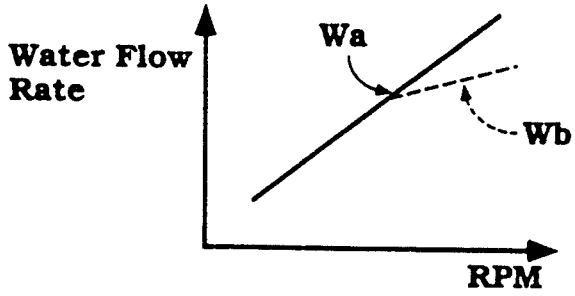
FIG. 7 is a graph of the coolant system water flow rate as a function of engine RPM, showing the required water flow rate (Wa) achievable in accordance with the invention.
Figure 8:
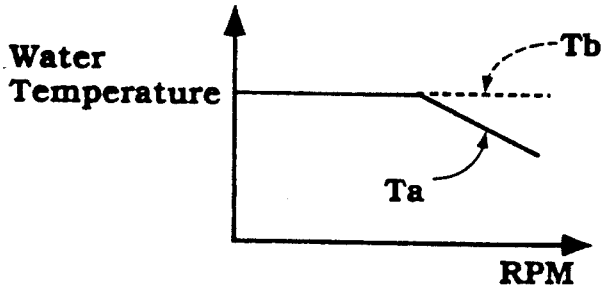
FIG. 8 is a graph of the coolant system water temperature as a function of engine RPM, showing the desired cooling jacket water temperature (Ta) achievable in accordance with the invention.

Certain water flow rate and cooling jacket temperature characteristics and requirements are shown graphically in FIGS. 7 and 8. FIG. 7 is a graph of the water flow rate as a function of engine RPM. The line Wa shows the water flow rate which the engine requires. When utilizing only a thermo-sensitive control valve, however, only the curve Wb may normally be obtained. The rate Wa may be achieved by employing the pressure-sensitive valve device of this invention, opening at the predetermined limit, in combination with a thermo-sensitive valve device.

FIG. 8 is a graph of the water temperature as a function of engine RPM. The required water flow rate curve Wa of FIG. 7 can be achieved by utilizing a thermo-sensitive valve having opening characteristics in accordance with the water temperature as shown by the curve Ta. However, most thermostats have a constant character as depicted by the line Tb. Using the pressure-sensitive valve device of this invention, under high engine RPM conditions, the higher flow rate thus achievable allows the attainment within the cooling jacket of a water temperature corresponding to the curve Ta.

Although an effective coolant flow control arrangement for the water cooling system of an engine has been illustrated and described above, various changes and modifications may be made without departing from the spirit and scope of the invention, as defined by the appended claims.

It is claimed:

1. A water cooling system for a marine propulsion unit comprising: a coolant jacket having an input port and a discharge port; a pressure sensitive valve device responsive to a pressure differential in said coolant jacket, and wherein said pressure sensitive valve device is open to flow therethrough when said pressure differential exceeds a predetermined limit; a temperature sensitive valve device, said temperature sensitive valve device and said pressure sensitive valve device positioned within said cooling system in parallel flow paths; and wherein said pressure sensitive valve device and said temperature sensitive valve device are located just beyond said discharge port of said coolant jacket.

2. The cooling system of claim 1 wherein said pressure differential equals the difference between a line pressure at said input port of said coolant jacket and a line pressure at said discharge port of said coolant jacket.

3. The cooling system of claim 2 further comprising an engine positioned within said marine propulsion unit; and a coolant output passage, located in said cooling system just beyond said pressure sensitive valve device and said temperature sensitive valve device, for discharging coolant from said engine.

4. The cooling system of claim 3 wherein said temperature sensitive valve device includes means operative to control coolant flow within said cooling system in a low RPM operation range of said engine, and said pressure sensitive valve device includes means operative to control coolant flow within said cooling system in a high RPM operation range of said engine.

5. The cooling system of claim 4 wherein said pressure sensitive valve device is operative to control coolant flow within said cooling system when the coolant temperature raises to a level at which said temperature sensitive valve device reaches its maximum opening limit for allowing coolant flow therethrough.

6. The cooling system of claim 5 wherein said cooling system is an open cooling system.

7. The cooling system of claim 6 wherein said open cooling system is operative to draw coolant from a body of water within which said marine propulsion unit operates, and to discharge said coolant back into said body of water from said coolant output passage.

8. The cooling system of claim 1 wherein said pressure sensitive valve device is provided with an encasement assembly having an output area and first and second input areas, and a diaphragm; wherein said diaphragm is disposed within said encasement assembly between said first and second input areas.

9. The cooling system of claim 8 wherein said diaphragm is moveable in response to said pressure differential.

10. The cooling system of claim 9 further comprising a valve body and a seating structure, both disposed within said encasement assembly of said pressure sensitive valve device; said valve body variably moveable from a position contacting said seating structure, whereat said pressure sensitive valve device is fully closed to flow therethrough, to a position whereat said valve body is unseated and said pressure sensitive valve device is fully opened.

11. The cooling system of claim 10 wherein said valve body communicates with said diaphragm, said valve body movement being responsive to said diaphragm movement.

12. The cooling system of claim 11 further comprising a means for applying a biasing force against said valve body in a direction towards said seating structure; and wherein said biasing force is equal to said pressure differential predetermined limit.

13. The cooling system of claim 12 wherein said pressure differential equals the difference between a line pressure at said input port of said coolant jacket and a line pressure at said discharge port of said coolant jacket.

14. The cooling system of claim 13 wherein said cooling system is an open cooling system for an internal combustion engine; and wherein said internal combustion engine is embodied in a powerhead for said marine propulsion unit.

15. The cooling system of claim 14 further comprising a coolant output passage, located in said cooling system just beyond said pressure sensitive valve device and said temperature sensitive valve device, for discharging coolant from said engine.

16. The cooling system of claim 15 wherein said temperature sensitive valve device includes means operative to control coolant flow within said cooling system in a low RPM operation range of said engine, and said pressure sensitive valve device includes means operative to control coolant flow within said cooling system in a high RPM operation range of said engine.

17. The cooling system of claim 16 wherein said pressure sensitive valve device is operative to control coolant flow within said cooling system when the coolant temperature reaches a level at which said temperature sensitive valve device reaches its maximum opening limit for allowing coolant flow therethrough.

18. The cooling system of claim 1 wherein said pressure sensitive valve device is provided with first and second input areas and an output area; and wherein said first input area receives a first pressure value from said input port of said coolant jacket and said second input area receives a second pressure value from said discharge port of said coolant jacket; and wherein said pressure differential equals the difference between a line pressure at said input port of said coolant jacket and a line pressure at said discharge port of said coolant jacket.

19. The cooling system of claim 18 further comprising an engine positioned within said marine propulsion unit; and a coolant output passage located in said cooling system just beyond said pressure sensitive valve device and said temperature sensitive valve device.

20. The cooling system of claim 19 wherein said cooling system is an open cooling system; and said open cooling system is operative to draw coolant from a body of water within which said marine propulsion unit operates and to discharge said coolant back into said body of water from said coolant output passage.

21. The cooling system of claim 1 further comprising a line pressure at said discharge port of said coolant jacket; wherein said line pressure at said discharge port of said coolant jacket exerts a force within said pressure sensitive valve device in a direction tending to close said pressure sensitive valve device to flow therethrough.

22. The cooling system of claim 13 wherein said line pressure at said discharge port of said coolant jacket exerts a force against said diaphragm in a direction tending to seat said valve body against said seating structure.

23. The cooling system of claim 18 wherein said second pressure value exerts a force within said second input area in a manner tending to close said pressure sensitive valve device to flow therethrough.

* * * * *